US007299671B2

(12) United States Patent
Caporusso et al.

(10) Patent No.: US 7,299,671 B2
(45) Date of Patent: Nov. 27, 2007

(54) BENDING DEVICE FOR BENDING MACHINE

(75) Inventors: Alessandro Caporusso, Piedimonte San Germano (IT); Mario Giorgio, Piedimonte San Germano (IT)

(73) Assignee: CML International S.p.A., Piedimonte San Germano FR (IT)

( * ) Notice: Subject to any disclaimer, the term of this patent is extended or adjusted under 35 U.S.C. 154(b) by 120 days.

(21) Appl. No.: 11/335,703

(22) Filed: Jan. 20, 2006

(65) Prior Publication Data

US 2006/0174671 A1 Aug. 10, 2006

(30) Foreign Application Priority Data

Jan. 25, 2005 (IT) ..... RM2005A0035
Mar. 25, 2005 (IT) ..... RM2005A0146

(51) Int. Cl.
*B21D 7/04* (2006.01)
*B21J 9/18* (2006.01)

(52) U.S. Cl. ..... 72/149; 72/159; 72/453.02

(58) Field of Classification Search ..... 72/149, 72/154–159, 453.01, 453.02
See application file for complete search history.

(56) References Cited

U.S. PATENT DOCUMENTS 2,638,142 A * 5/1953 Green ..... 72/153
3,410,125 A 11/1968 Schmidt
4,038,853 A * 8/1977 Schwarze ..... 72/157

FOREIGN PATENT DOCUMENTS

GB 126845 5/1919

* cited by examiner

*Primary Examiner*—Derris H. Banks
*Assistant Examiner*—Teresa M. Bonk
(74) *Attorney, Agent, or Firm*—Young & Thompson

(57) ABSTRACT

A bending device for bending machine comprises a matrix (2), a countermatrix (6), and a die (7) able to prevent wrinkles. A countermatrix-holder support element (8) is fixed on an upper slide (10), which is slidable transversally to a workpiece T to be bent on a lower slide (11) movable in turn in the same direction of the upper slide (10), on a table (12). A first double-acting cylinder (19), being fixed on said lower slide (11), moves the countermatrix (6) toward and away from the workpiece (T); and a second double-acting cylinder (24) is slidable on the upper slide (10) and connected to a slider (25) on a counteracting rod (26) which is pivoted about an end of an arm-turning spindle (3), so that a force is exerted on the countermatrix-holder support element (8) in a projecting portion (23) thereof.

9 Claims, 5 Drawing Sheets

BENDING DEVICE FOR BENDING MACHINE

FIELD OF THE INVENTION

The present invention relates to a bending device for bending machine.

Even if in the following description a fixed radius pipe bending machine is taken as an example of a bending machine, it is clear that the invention has not to be intended as limited to that machine, but the invention can be also embodied to a variable radius pipe bending machine. Further, the invention can be also employed to work not only pipes but section bars in general, which are called workpieces below.

BACKGROUND OF THE INVENTION

Such a bending device comprises a rotating bend die or matrix and a vice facing the matrix. Said vice is mounted on a bend arm and clamps a section of the workpiece immediately after the section to be bent, according to a feeding direction of the workpiece. The bending device comprises also a pressure die or countermatrix, which is located directly before the clamped section of the workpiece, the countermatrix being not rotating together with the bend arm. When the workpiece is drawn around the matrix, the countermatrix moves together with the workpiece, to withstand the radial opposite forces of the workpiece. In addition to the countermatrix, a die able to prevent wrinkles is mounted on the not rotating part of the bending machine opposite the countermatrix, and is adjustable in its position with respect to the matrix configuration. The not rotating part of the bending machine, which can be of any known kind, e.g. being shaped as both a bench or a longitudinal member, with mandrel or without, is not relevant for the present invention and will not be described here.

Some problems that are met in known bending machines concern first of all the construction of the countermatrix unit which must be very robust, and then bulky, to withstand the opposite forces exerted by a workpiece being worked. In fact, construction deficiency of the countermatrix unit creates working defects, such as not uniform radius of a bend and not correct dimensions of the worked piece. For this reason such a construction needs a special design, which contributes to raise costs of bending machines.

Further, in known bending machines the die able to prevent wrinkles is driven by its own drive control to be correctly positioned with respect to the workpiece. Such a drive control of the die able to prevent wrinkles is located opposite a drive control which is used to position the countermatrix. This requests that an operator has troublesomely to move around the machine, to position both the die able to prevent wrinkles and the countermatrix according to the piece to be bent.

SUMMARY OF THE INVENTION

The present invention aims to overcome the drawbacks above mentioned.

An object of the invention is to provide constructions and arrangements of countermatrix so that they are less robust and bulky, and then cheaper, than those normally used in known bending machines, although they remain equally efficient in withstanding opposite forces of the piece being worked.

Another object of the invention is to provide a simple, reliable operating means of the countermatrix.

Further an object of the invention is to provide an operating means of the die able to prevent wrinkles, that can be controlled from one side of the machine.

According to the invention, a bending device for bending machine comprises a bending die or matrix, a pressure die or countermatrix, and a die able to prevent wrinkles. The matrix, about which matrix a workpiece is bent, is mounted on an arm-turning spindle. The countermatrix, which is adapted to withstand opposite forces of the workpiece in a bending operation, is hold by its countermatrix-holder support element being fixed on an upper slide which is mounted slidable in transversal direction to the workpiece on a lower slide movable in turn in the same direction of the upper slide, on a table. The die able to prevent wrinkles is hold by its die support element so as to face the countermatrix.

The countermatrix exerts on the workpiece an adequate pressure by a first operating means comprising first and second double-acting cylinders. The first double-acting cylinder is fixed on the lower slide and has a first cylinder piston rod acting on a portion of said countermatrix-holder support element to move the countermatrix toward and away from the workpiece. The second double-acting cylinder is slidable on the upper slide and connected to a slider on a counteracting rod being pivoted about an end of the arm-turning spindle. The slider is designed to abut against a first stop on said counteracting rod so that a second cylinder piston rod exerts a force on the countermatrix-holder support element in a projecting portion thereof which is situated beside said portion where the first cylinder piston rod acts.

Advantageously, the second double-acting cylinder is further slidably mounted through a vertical plate on a threaded rod rigidly connected to the support bench, the vertical plate being designed to abut against a second stop on the threaded rod when the slider on the counteracting rod abuts against the first stop. It should be appreciated that the above modification with two stops makes the first operating means stronger than that with only one stop.

Further, the countermatrix and the die able to prevent wrinkles exert on the workpiece an adequate pressure by a second operating means acting on the die able to prevent wrinkles through the support elements of the countermatrix and the die able to prevent wrinkles before a bend arm, that is fixed around said arm-turning spindle, performs a bending operation by clamping and drawing a section of the workpiece. The second operating means comprises a die slide on which the die support element for a die able to prevent wrinkles is mounted, the die slide being slidable on the table integrally, through connecting means, to the lower slide.

BRIEF DESCRIPTION OF THE DRAWINGS

The present invention will be described referring to its preferred embodiments, in connection with the enclosed drawings, in which.

DETAILED DESCRIPTION OF PREFERRED EMBODIMENTS

Figure 1:
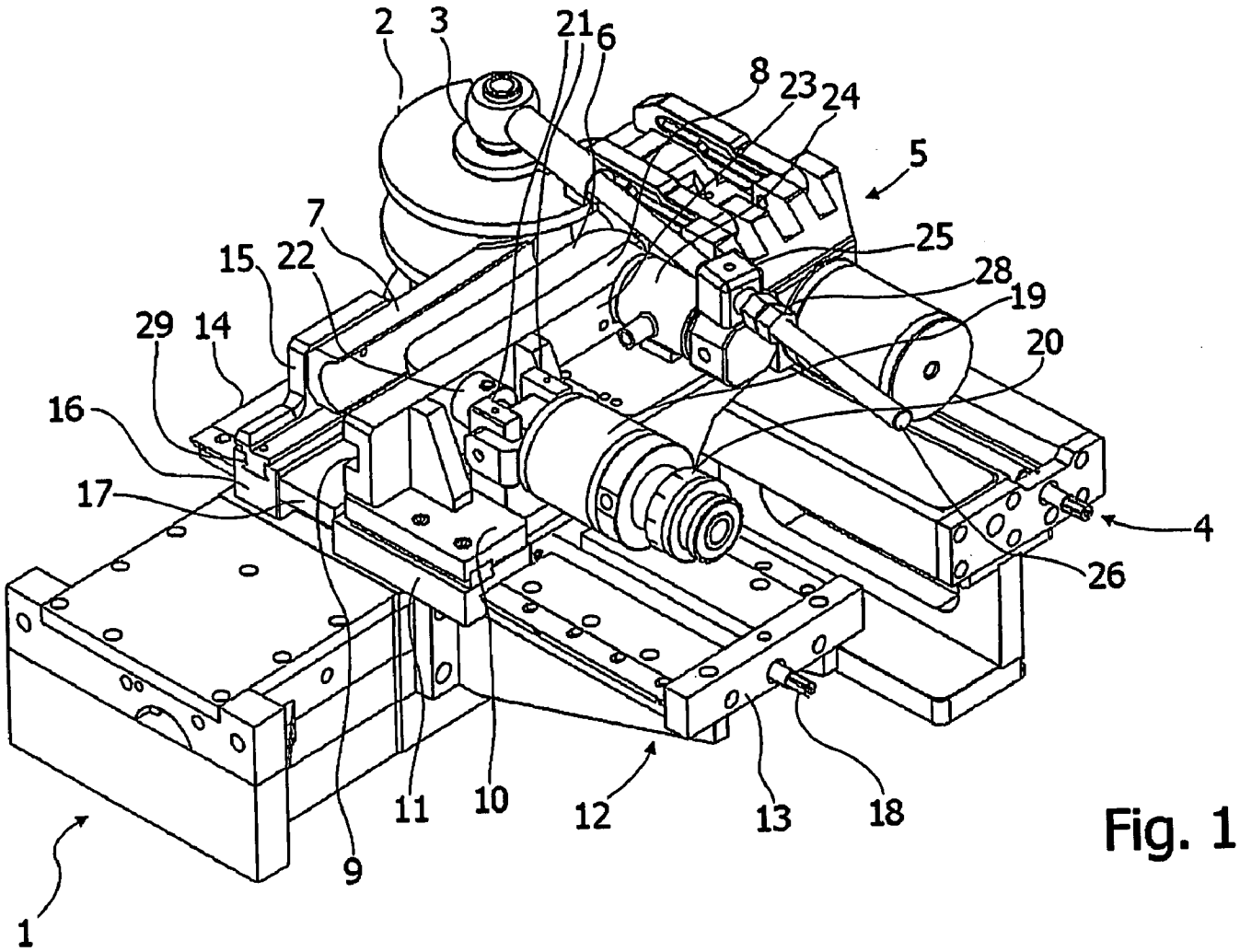
FIG. 1 shows in a perspective view a first embodiment of a bending device according to the invention.

Referring to the drawings, a first embodiment of bending device according to the invention is shown in FIG. 1 in a perspective view, as mounted on a support bench 1 of a bending machine. The bending machine extending to the left-hand direction in the figure is not shown. A bend die or matrix 2 is pivotally mounted on the support bench 1 about a arm-turning spindle 3. As usual in this kind of machines a bend arm 4 is fixed around the arm-turning spindle 3 in order to swing with the latter. The bend arm 4 is provided with a vice 5 designed to clamp a piece to be bent, i.e. a pipe T, as shown in FIGS. 2 and 3 which are top plan views of the same bending machine.

Figure 2:
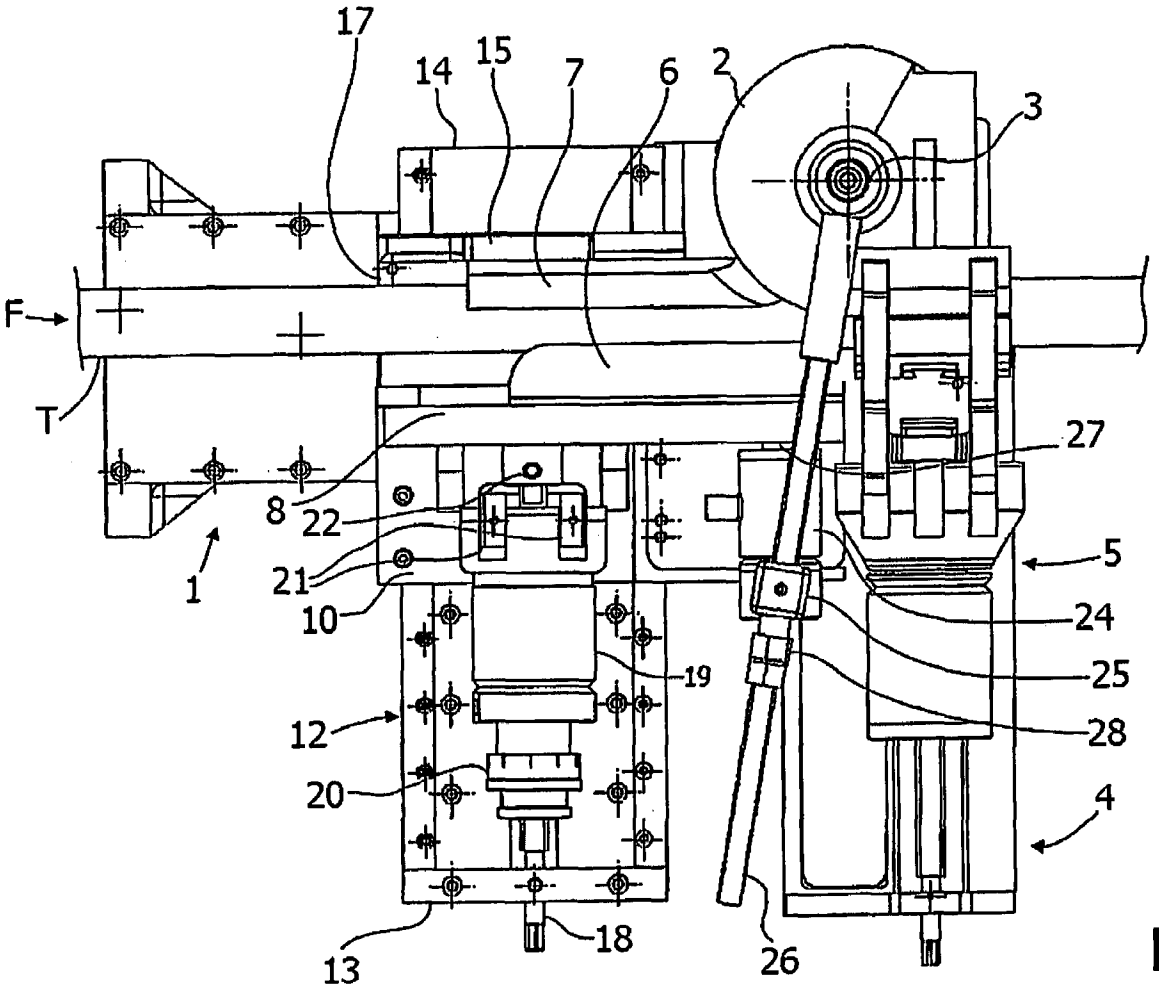
FIG. 2 shows in a top plan view the first embodiment of bending device in FIG. 1, with a workpiece to be bent being put on the device but not clamped between the countermatrix and the die able to prevent wrinkles.
Figure 3:
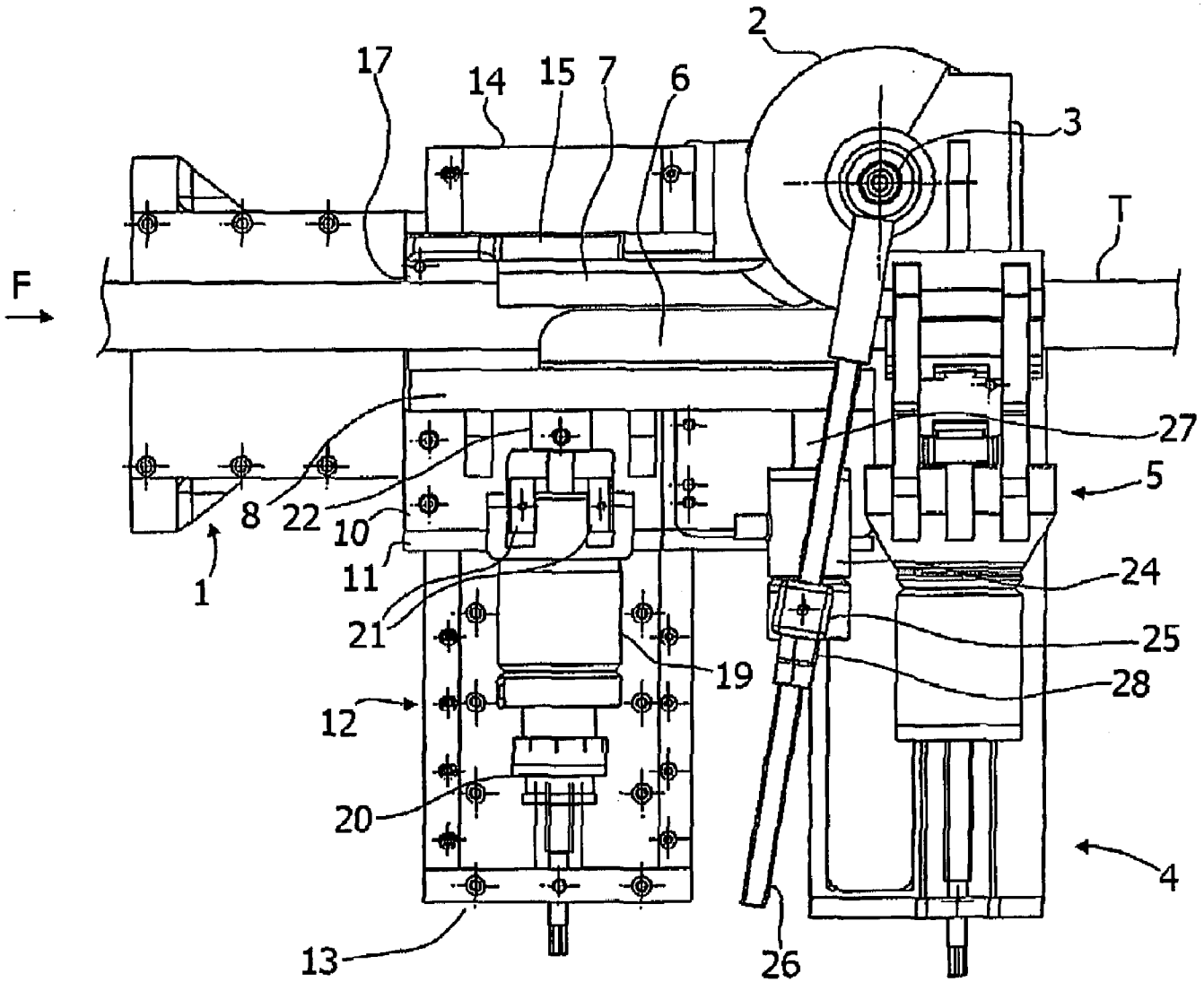
FIG. 3 shows in a top plan view the first embodiment of bending device in FIG. 1, with a workpiece to be bent being put on the device and clamped between the countermatrix and the die able to prevent wrinkles.

The pipe T is clamped by the vice 5 in its section immediately after the section to be bent, according to a feeding direction of the pipe T, which is indicated by an arrow F in FIGS. 2 and 3. Further, the pipe T is subjected to a pressure between a pressure die or countermatrix 6 and a die 7 able to prevent wrinkles, in a section before the matrix 2, according the arrow F. The countermatrix 6 is hold slidably on its support element 8 in feeding direction of the pipe T by means of a prismatic joint whose mortise is indicated as 9 in FIG. 1. The countermatrix-holder support element 8 is able to withstand opposite forces of the pipe T during a bending operation. The countermatrix 6 is movable in a known way along the support element 8.

Referring to FIG. 2 in particular, according to a first embodiment of the invention, the countermatrix-holder support element 8 is fixed on an upper slide 10. The upper slide 10 is transversally slidable with respect to the pipe T on a lower slide 11, which is in turn movable in the same direction of the upper slide 10 on a table 12. The table 12 is fixed transversally to the support bench 1, being projecting therefrom with a front table portion 13 and a rear table portion 14.

Opposite the countermatrix 6 on the same table 12 is the die 7 able to prevent wrinkles, which is hold by its die support element 15 slidably mounted by a prismatic joint 29 on a die slide 16 transversally sliding on the table 12 in the same direction of the lower slide 11. According to the first embodiment of the present invention, the slide 16 is connected to the lower slide 11 through connecting means, such a spacer 17 whose width depends on the diameter of the pipe T to be bent.

In the front table portion 13 there is provided a driving device moving fast slides 11 and 16 forward and backward, which are connected together by the spacer 17, the driving device being for example a shaft 18 with a screw-and-nut assembly (not shown) which is located between the lower slide 11 and the table 12 and operated by a handwheel (non shown).

In virtue of the arrangement above described, by operating on both the shaft 18 and the prismatic joint 29, the die 7 able to prevent wrinkles can be positioned with respect to the matrix 2, and also the countermatrix 6, mounted on its support element 8 opposite the die 7, can be approached to the matrix 2 according to a selection of the spacer 17. The spacer 17 has various sizes based on a workpiece and a kind of working.

Further, a first double-acting cylinder 19, having a piston rod 22, operates on the countermatrix-holder support element 8, which is fixed on the upper slide 10. The piston rod stroke is set by a manually controlled knob 20 of the first double-acting cylinder 19 in order to achieve a micrometric adjustment of the position of the countermatrix 6 before and after a working operation.

The first double-acting cylinder 19 is fixed on the lower slide 11 by means of brackets 21, 21, so that the upper slide 10 can be moved in the same direction of the first cylinder piston rod 22 with respect to the table 12.

Thus, the assembly of slides 10, 11, and 16 can be moved fast forward and backward by means of the shaft 18 with a screw-and-nut assembly. The first double-acting cylinder 19 is part of first operating means acting directly on the countermatrix-holder element support 8. The first cylinder piston rod 22 acts on a portion of the support element 8 to move the countermatrix 6 towards the pipe T to be bent, and, vice versa, away from it.

On a projecting portion 23, being cantilevered to the table 12, of the support element 8, a second double-acting cylinder 24 operates as another part of said first operating means.

The second double-acting cylinder 24, having a piston rod 27, is mounted slidably on the upper slide 10 by means of a slider 25 which is movable on a counteracting rod 26. The counteracting rod 26 is pivoted about an end of the arm-turning spindle 3. The second cylinder piston rod 27 (shown in FIGS. 2 and 3) abuts on the projecting portion 23 of the support element 8. On the counteracting rod 26 there is a first adjustable stop 28. This first adjustable stop 28 is diagrammatically represented as a couple of nuts which are screwed in a threaded portion of the counteracting rod 26 and can be locked as stud bolts.

When the second cylinder piston rod 27 extends outside the cylinder 24, the slider 25 is designed to abut against the first adjustable stop 28 on the counteracting rod 26 in such a way that the second cylinder piston rod 27 applies a force on the countermatrix-holder support element 8 in its projecting portion 23, which is situated beside the portion where the first cylinder piston rod 22 operates.

When both the first operating means in the form of two double-acting cylinders 19, 24 are controlled through a pressured fluid, such oil fed by one or more hydraulic circuits (not shown in details), the pressure die or countermatrix and the die able to prevent wrinkles exert on the pipe to be bent an adequate pressure that counteracts the opposite forces exerted by the pipe T in the bending operation thereof.

A second operating means acting onto the die able to prevent wrinkles is represented by the die slide 16 (FIG. 1) on which the support element 15 of the die 7 able to prevent wrinkles is mounted. The die slide 16, which, as above mentioned, is connected to the lower slide 11 by means of the spacer 17, is positioned by the shaft 18 with a screw-and-nut assembly.

Referring to FIG. 2, the countermatrix 6 hold by its support element 8 is shown yet far from the pipe T, whereas the die 7 able to prevent wrinkles is already near the pipe T. The correct distance is determined by the spacer 17 connecting slides 11 and 16, and by the micrometric adjustment of the knob 20 of the first double-acting cylinder 19.

With reference to FIG. 3, the upper slide 10 is seen moved with respect to lower slide 11 by the operation of the first double-acting cylinder 19 and the second double-acting cylinder 24. The first double-acting cylinder 19, which is fixed to the lower slide 11, acts directly by its first cylinder piston rod 22 on the support element 8. The second double-acting cylinder 24 is movable on the counteracting rod 26 by the slider 25. As the slider 25 abuts on the first suitably adjusted stop 28, the second cylinder piston rod 27 presses the projecting portion 23 against the pipe T.

In this way, the countermatrix 6, slidably mounted on the support element 8 can apply an adequate pressure without structural deformations on the pipe which counteracts while it is bent.

Figure 4:
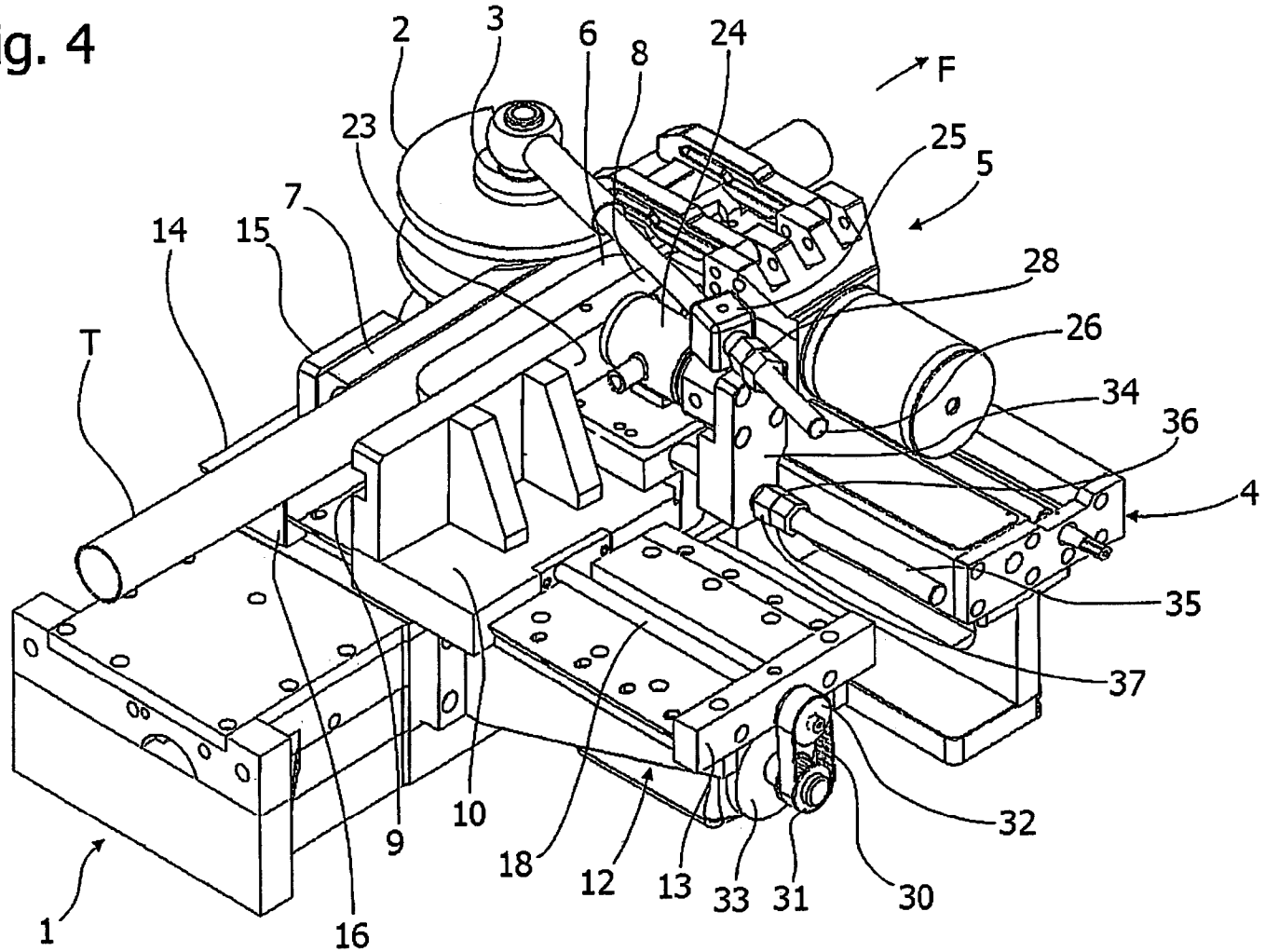
FIG. 4 shows in a perspective view a second embodiment of a bending device according to the invention, with a workpiece to be bent being put on the device but not clamped between the countermatrix and the die able to prevent wrinkles.
Figure 5:
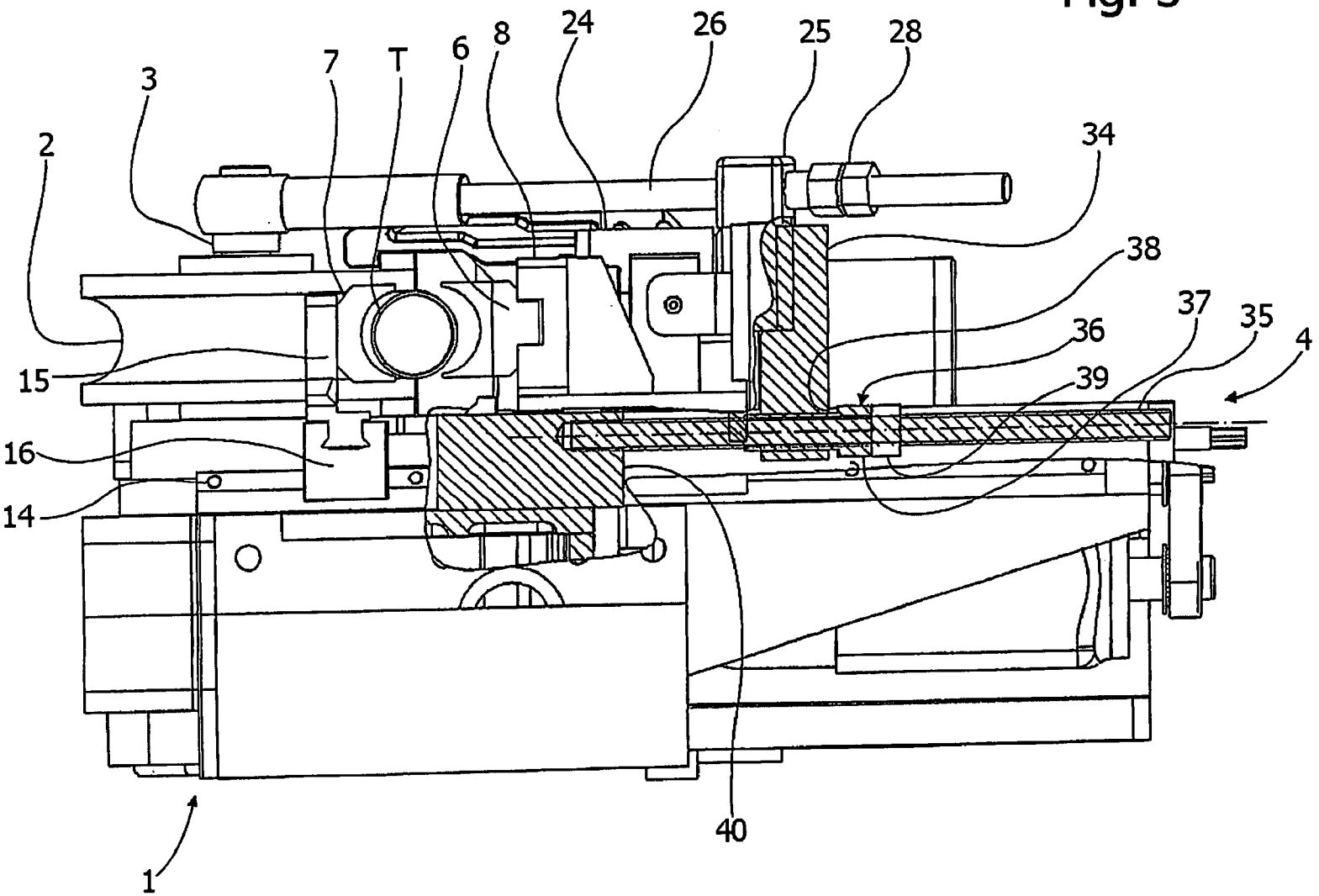
FIG. 5 shows in a left-hand cutaway elevation view the second embodiment of the bending device in FIG. 4.

Referring now to FIGS. 4 and 5, a second embodiment of a bending device according to the present invention is shown. In FIGS. 4 and 5, which are a perspective view and a left-hand elevation view respectively, of the bending device partially in cross-section, equal reference numerals are used to indicate parts equal or similar to those in the first embodiment.

Referring to FIG. 4 in particular, according to the second embodiment of the invention, the countermatrix-holder support element 8 is fixed on a slide 10. The slide 10 is transversally slidable with respect to the pipe T on a table 12. The table 12 is fixed transversally to a support bench 1, being projecting therefrom with a front table portion 13 and a rear table portion 14.

Mounted opposite a countermatrix 6 on the same table 12 is a die 7 able to prevent wrinkles, which is hold by its die support element 15 slidably mounted on a slide 16 transversally sliding on the table 12 in the same direction of the slide 10. Differently from the first embodiment the slide 16 is adjustable in its position on the table 12 independently of the slide 10.

In the front table portion 13 there is provided a driving device moving fast the slide 10 forward and backward by a flexible transmission 30 and a couple of pulleys 31, 32. The pulley 31 is keyed to the shaft of a motor 33, and the pulley 32 is keyed to a shaft 18 with a screw-nut screw assembly (not shown) which is located between the slide 10 and the table 12.

It should be appreciated that the above arrangement, in which the shaft 18 with a screw-and-nut assembly is part of operating means acting directly only on the countermatrix-holder support element 8, is not to be considered preferable to that in the first embodiment of the invention. In this second embodiment, only for clarity sake, the first double-acting cylinder of the first operating means is not shown, as it would cover other features that will be described below.

On a projecting portion 23 of the support element 8, beside the portion on which the shaft 18 with a screw-and-nut assembly acts and cantilevered on the slide 10, a further part of operating means of the countermatrix-holder support element 8 in the form of a double-acting cylinder 24 operates. Hydraulic feeding circuits of the double-acting cylinder 24 are not shown.

The double-acting cylinder 24 is mounted slidably by means of a slider 25 on a counteracting rod 26. The counteracting rod 26 is pivoted about an end of the arm-turning spindle 3. The piston rod 27 of the cylinder 24 (shown in FIG. 5) abuts on the projecting portion 23 of the support element 8. On the counteracting rod 26 there is a first adjustable stop 28. This first adjustable stop 28 is diagrammatically represented as a couple of nuts which are screwed in a threaded portion of the counteracting rod 26 and can be locked as stud bolts.

The slider 25 and the cylinder 24 integral thereto are rigidly connected to a plate 34 vertically arranged and extending downward.

The plate 34 has at the bottom a through hole for a threaded rod 35. A second stop 36, preferably in the form of a sleeve having a hexagonal head portion 37 and a smooth portion 38, is internally threaded as the threaded rod 35. The second stop 36 can be adjusted in its position along the threaded rod 35 by means of a spanner engaging the hexagonal head portion 37 of the second stop 36. The plate 34 is slidable on the smooth portion 38 of the second stop 36 and the mutual position between the plate 34 and the second stop 36 is locked through a nut 39 when it is tightened against the hexagonal head portion 37.

The threaded rod 35 is connected, e.g. by threaded coupling, to a block 40 of the bench 1, as shown in FIG. 5.

In working, by using the operating means of the countermatrix-holder support element 8 according to the second embodiment of the bending device, the slider 25 is designed to abut against the first stop 28 on the counteracting rod 26, and the vertical plate 34 is designed to abut against the second stop 36 correspondingly adjusted in its position on the threaded rod 35.

In this way, when the slide 10 holding the support element 8 is displaced by the operating unit 30-33 so that the countermatrix 6 is brought against the pipe T the double-acting cylinder 24 is also operated in such a way that its piston rod 27 exerts a force on the same countermatrix-holder support element 8 in its projecting portion 23. All the bending device construction withstands adequately this force of the double-acting cylinder 24, as the latter is counteracted on the top by the slider 25 abutted against the first stop 28 on the counteracting rod 26, which is pivoted about the arm-turning spindle 3, and at the bottom through the vertical plate 34, by the second stop 36 on the threaded rod 35, which is screwed to the block 40 integral to the bench 1.

Such a counteracting arrangement according to the second embodiment permits the bending device of the present invention to work pipes having both diameter and thickness greater than those which can be worked in a bending machine without such a counteracting arrangement. It should be appreciated that this reduce the costs of a bending operation.

The invention has been described by way of example only in two embodiment thereof, but changes and modifications can be made without departing from the scope of the enclosed claims.

What is claimed is:

1. A bending device for bending machine, comprising:

a bending die or matrix, mounted on an arm-turning spindle, about which matrix a workpiece is bent, a pressure die or countermatrix, which is hold by its countermatrix-holder support element and is adapted to withstand opposite forces of the workpiece in a bending operation, a die able to prevent wrinkles, which is hold by a die support element so as to face the countermatrix, both the countermatrix and the die able to prevent wrinkles exerting on the workpiece an adequate pressure by a first operating means acting on the countermatrix and a second operating means acting on the die able to prevent wrinkles through said support elements of the countermatrix and the die able to prevent wrinkles before a bend arm, that is fixed around said arm-turning spindle, performs a bending operation by clamping and drawing a section of the workpiece, characterized in that:

said countermatrix-holder support element is fixed on an upper slide which is mounted slidable in transversal direction to the workpiece on a lower slide movable in turn in the same direction of the upper slide, on a table;

said first operating means comprises:

a first double-acting cylinder, being fixed on said lower slide and having a first cylinder piston rod acting on a portion of said countermatrix-holder support element to move the countermatrix toward and away from the workpiece; and a second double-acting cylinder which is slidable on the upper slide and connected to a slider on a counteracting rod being pivoted about an end of said arm-turning spindle, the slider being designed to abut against a first stop on said counteracting rod so that a second cylinder piston rod exerts a force on said countermatrix-holder support element in a projecting portion thereof which is situated beside said portion where the first cylinder piston rod acts; and said second operating means comprises a die slide on which said die support element for a die able to prevent wrinkles is mounted, said die slide being slidable on said table integrally, through connecting means, to said lower slide.

2. The bending device according to claim 1, characterized in that said connecting means between said die support element for a die able to prevent wrinkles and said lower slide comprises a spacer having various sizes based on the workpiece and a kind of working.

3. The bending device according to claim 1, characterized in that said first double-acting cylinder is provided with a manual adjustment knob, by which the first cylinder piston rod is adjusted in its stroke.

4. The bending device according to claim 1, characterized in that said projecting portion of countermatrix-holder support element on which said second cylinder piston rod presses is cantilevered with respect to the table.

5. The bending device according to claim 1, characterized in that said first stop is adjustable in its position on the counteracting rod.

6. The bending device according to claim 5, characterized in that said first adjustable stop is formed with a couple of stud bolts-like nuts on a threaded section of said counteracting rod.

7. The bending device according to claim 1, characterized in that said second double-acting cylinder, which is slidable through the slider on the counteracting rod being pivoted about an end of said arm-turning spindle, is further slidably mounted through a vertical plate on a threaded rod rigidly connected to said support bench, the vertical plate being designed to abut against a second stop on said threaded rod when the slider on the counteracting rod abuts against said first stop.

8. The bending device according to claim 7, characterized in that said second stop is adjustable on said threaded rod.

9. The bending device according to claim 8, characterized in that said second stop is in the form of an internally threaded sleeve having a hexagonal head portion and a smooth portion, externally engaging the vertical plate, the second stop being adjustable in its position along the threaded rod by acting on the hexagonal head portion by a spanner.

* * * * *